US008506417B2

(12) United States Patent
Sansbury

(10) Patent No.: US 8,506,417 B2
(45) Date of Patent: Aug. 13, 2013

(54) GOLF CLUB ENABLING PRECISE SWINGING MOVEMENT

(76) Inventor: Harold Sansbury, Rancho Mirage, CA (US)

( * ) Notice: Subject to any disclaimer, the term of this patent is extended or adjusted under 35 U.S.C. 154(b) by 111 days.

(21) Appl. No.: 12/658,654

(22) Filed: Feb. 12, 2010

(65) Prior Publication Data

US 2011/0201445 A1 Aug. 18, 2011

(51) Int. Cl.
*A63B 53/16* (2006.01)

(52) U.S. Cl.
USPC ..... 473/294; 473/295; 473/299

(58) Field of Classification Search
USPC ..... 473/293–299
See application file for complete search history.

(56) References Cited

U.S. PATENT DOCUMENTS

| | | | | | |
|---|---|---|---|---|---|
| 1,435,088 | A * | 11/1922 | Smith | 473/302 |
| 2,445,718 | A * | 7/1948 | Sternberg et al. | 473/204 |
| 3,606,326 | A * | 9/1971 | Sparks | 473/300 |
| 4,252,317 | A * | 2/1981 | Vezina | 473/294 |
| 4,621,816 | A * | 11/1986 | Leek | 473/293 |
| 5,431,401 | A * | 7/1995 | Smith | 473/251 |
| 5,474,300 | A * | 12/1995 | Scalise et al. | 473/201 |
| D425,951 | S * | 5/2000 | Davis et al. | D21/736 |
| 6,394,911 | B1 * | 5/2002 | Vaughn | 473/294 |
| 6,776,724 | B1 * | 8/2004 | Siemsglusz | 473/294 |
| 7,232,379 | B2 * | 6/2007 | Riseley | 473/305 |
| 7,261,641 | B2 * | 8/2007 | Lindner | 473/297 |
| 7,422,526 | B2 * | 9/2008 | Nemeckay | 473/296 |
| 2005/0096152 | A1 * | 5/2005 | Kuo | 473/340 |
| 2007/0197310 | A1 * | 8/2007 | Lusky | 473/294 |
| 2008/0081708 | A1 * | 4/2008 | Wilmsen et al. | 473/297 |
| 2009/0137337 | A1 * | 5/2009 | Shin | 473/340 |

* cited by examiner

*Primary Examiner* — Stephen L. Blau

(57) ABSTRACT

A golf club which may be in the form of a so-called "putter" golf club and which is capable of being adjustable by a user to obtain consistent swinging movements with the golf club and thereby improve performance in the play of the game of golf. In particular, the handle portion is adjustably positionable allowing the user to locate his hands and arms in a position where he or she will generally always obtain a consistent swinging movement. In particular, the handle portion is formed of a pair of segments with one being rotatably moveable relative to the other and fixed in a precise location so that the head of the club (located at the lower end thereof) permits the striking face of the head to engage a golf ball consistently at a precise angle.

8 Claims, 6 Drawing Sheets

GOLF CLUB ENABLING PRECISE SWINGING MOVEMENT

BACKGROUND OF THE INVENTION

1. Field of the Invention

This invention relates in general to certain new and useful improvements in golf clubs and more particularly, to a putter golf club which can be adjusted and perfectly balanced such that a user can always swing the golf club in a path where a striking face on the head of the golf club is precisely perpendicular to the golf ball.

2. Brief Description of Related Art.

It is well known that in the game of golf, after striking a golf ball with a golf club and causing movement onto a putting green, the player must strike the ball with a "putter" golf club to move the same to a hole in the golf course. Moreover, the player must move the golf ball with a minimum number of swings of the golf club to achieve a winning score.

This invention therefor relates to a golf club such as a putter golf club which allows for consistency and improved accuracy in a swinging movement. This is accomplished by providing a handle for grasping by the player in which the user's hands can be located on the club to insure that the player can always swing the golf club with substantially the same movement and thereby enable the golf balls to consistently follow a fairly constant trajectory.

Even though a player in a game of golf attempts to use a consistent swinging pattern to achieve movement of a golf ball toward a hole that player rarely is able to achieve that consistent swinging pattern. This is largely caused by the pronation and supination of the user's hands while holding the golf club. Each player is different from one another in that each have developed their own grasping patterns. This often results in differences among players in engaging a golf club by the hands of the player. Many players will grasp a golf club differently from day to day. Although the differences may be slight and even unobservable, they are sufficient to cause differences in ball movement. As a result, consistency in the swinging movement by even the same player is difficult to achieve.

It would be desirable to have each putter tailored to the practice of the user, but this would result in a very costly undertaking. In short, the game of golf is a deceptively simple appearing game and when one observes making of the shots, or observes players on a golf course, they often conclude that the moving of a ball across a putting green, and toward a golf course hole, for example, is simple to perform. In reality experienced players can testify that, the putting of a golf ball into a hole of a golf course can be far more difficult.

One of the problems arising in the achieving of a proper putting position is the fact that physical characteristics of the player often interfere and give rise to inaccurate putting shots. As a simple example, it is important to ensure that the striking face or so-called "face" of the golf club is properly arranged with respect to the ball and that the putter shaft is swung in a desired path to achieve the desired ball trajectory.

In addition to the actual physical movements which are observable, other factors which will exert an influence on stance, and even club holding patterns of a player, but which are not necessarily observable, will have a significant effect on the swinging movement of a golf putter. As a simple example, the tension which a player may have in his or her arms on one day may not be present on another day and hence, the holding and even swinging of the golf club can vary from day to day. As a result, the desirably constant and reproduceable swinging of a golf putter is not easily achievable.

It must be recognized that even a slight variance in the angle of the putter head with respect to a desired ball trajectory, can make a significant difference in an attempt to cause the golf ball to follow a particular desired trajectory. Again, as a simple example, if the face of the putter head is off by one half degree, the golf ball will be moved in a path where it may be 4 to 5 inches from the hole of the golf course in a short distance of 4 to 5 feet.

In substance, the real problem lies in the fact that with a standard putter club, the vast majority of people have great difficulty in reproducibly swinging a golf club. Admittedly, each party swings the club differently from one another since some people are taller, or fatter, or for any other reason hold the "putter club" differently. However, as pointed out above, even the same party has difficulty in constantly reproducing a swing.

The club of the present invention literally overcomes these problems when used properly. It allows the player to properly grasp the club and provide a swinging movement such that the club head will always be precisely perpendicular to a desired trajectory of ball movement.

PURPOSES OF THE INVENTION

The present invention provides a golf club which permits a player to swing a golf club in a pattern which is not normally affected by the pronation or supination of a player and where the club head has a striking face in a plane perpendicular to a proposed trajectory between a ball and a golf course hole. It is further purpose of this invention to enable a player to grasp a golf putter, having a somewhat T-shaped handle, in a manner allowing the desired stance of the player to be easily achieved. This allows a player to engage the hand grip of the golf club so that the golf club is swung through an arc with a striking face of the head located generally perpendicular to a proposed trajectory of the golf ball. Moreover this allows a swinging movement of the golf club in a consistent and reproducable pattern. In essence, the golf club of the invention can be adjustable to accommodate an individual's physical characteristics, but allows the player to use a golf club in a accurately reproducable manner.

The above and other purposes will become clearly apparent from a consideration of the following brief summary of the invention and the more detailed description of the invention, as set forth below.

BRIEF SUMMARY OF THE INVENTION

It is well known that almost every golf player has a grip which is slightly different from that of another player. These differences may be relatively unobservable and lie in muscle tension. As a result, there are differences in club gripping force and the like. Moreover, it is well established that because of the physical structure of some people they will swing a golf club differently than many other people. Nevertheless, each of the players have that desired goal of swinging a golf club, including a putter, to move a golf ball on a ground surface to a golf course hole.

In a preferred embodiment, the golf club of the invention is preferably a so-called "putter" which is essentially designed to cause a rolling movement of a ball, as opposed to a movement where the ball is propelled through the air. A putter head is provided with a relatively flat forwardly facing surface, typically called a "striking face." The striking face is located at the lower end of the golf club so that when the club is swung, the striking face will engage the ball and move same to a desired position and this desired position is, again, preferably a hole on a golf course. Most putting green landscapes are arranged so that the putting green is relatively flat and is not horizontally skewed at any substantial angle from a horizontal plane. In this way, a golf ball will only roll through the action of a propelling force and will generally not move as a result of the force of gravity. As a result, the movement of a golf ball is theoretically attributable entirely to a swinging movement of a player who strikes a golf ball on that putting green with a playing club, typically a putter. It would be highly desirable for the player to engage and move the putter precisely in a direction which allows for a consistent trajectory of the ball with respect to the cup on each swing.

The golf club of the invention comprises a main shaft having a height sufficient so that a handle on the golf club is located in a region slightly below the waist of the player. A club head is mounted on the lower end of the golf club so that when the club is swung in an arcuate path, a striking face on the club head will engage the golf ball.

One unique facet of the invention is the fact that the club head of the golf club is angulated outwardly from a central axis of the club. This angulation is preferably between 10 and 22 degrees, but can vary depending upon the player and the desired specifications of that player. Ideally, the angle of the offset portion is preferably 18 degrees but, again, can vary as indicated. This allows the club head to be spaced outwardly from the player so that it will not contact the player's feet when the club head is moved in a normal swinging pattern. More specifically, the player can bend his head slightly and look at the golf club from a position in which the striking face of the putter is precisely perpendicular to a ball trajectory when the club is swung.

In addition to the offset between a major portion of an axis of the club shaft and the striking face of the club head, as described above, the golf club of the present invention also relies upon a two piece handle. This improved handle allows for a grasping of a hand engageable grip section located along the length of the shaft to be engaged and physically held by a palm of a lower hand of a user. There is also a perpendicularly arranged handle in close proximity to the upper end of the golf club shaft to be engaged by an upper hand of a user. This above construction allows a user to apply a grasping force to physically hold the golf club shaft along its length with his lower hand and to apply a swinging movement while the shaft is effectively pivoted on a pair of fingers of the users opposite or upper hand. The handle includes a small rod perpendicularly located to an axis of the shaft and at the upper end of the shaft. The small rod is also capable of fitting between a pair of fingers of a users hand. Moreover, the handle portion is positionable with respect to a longitudinal axis passing through the golf club shaft. It should be noted by reference to the following described figures, that the rod of the handle extends generally parallel to the face of the club head.

This upper crown section is angularly positionable with respect to the remainder of the shaft, and can be retained in a desired angular position and at a selected angle. The upper crown section of the shaft is also rigidly but releasably securable to the upper end of the shaft. The T-shaped handle section is essentially mounted on a round top portion of the upper cross section of the shaft, and the aforesaid rod extends through the upper crown section perpendicular to the axis of the crown. A rod is slidably positionable in that crown perpendicular to the longitudinal axis thereof. In accordance with this construction, not only is the club head offset from a truly vertical arrangement with the shaft, the angle of the rod extending through the crown can be varied relative to the axis of the putter shaft.

The upper angularly positionable crown section and rod are together referred to as a handle since the club can be grasped and held by this handle with a users upper hand, (that hand being a left hand if the user is right handed). The right hand engageable section along the length of the shaft is referred to as gripping section. It follows from the previous description, that the putter club is used by engaging the gripping section with one hand and the handle with the other hand.

The term "positioning means" refers to the means for adjusting the position of the crown to the axis of the shaft. This adjusting means allows for the position of the upper crown section with respect to the remainder of the shaft. This will allow the crown to be moved rotatably at an angle relative to the remainder of the putter shaft, and allows a user a wide degree of adjustability so that the club can be adjusted to the particular user. The details of construction of the handle relative to the shaft are hereinafter described in more detail. However, it should be recognized that this construction is unique since it allows for a complex variety of movements of the handle portion relative to the shaft.

This present invention thereby provides a unique and novel golf club which enables a precise swinging movement and which thereby fulfills all of the above-identified purposes and other purposes which will become more fully apparent from a consideration of the forms in which it may be embodied. One of these forms is more fully illustrated in the accompanying drawings and described in the following detailed description of the invention. However, it should be understood that the accompanying drawings and this detailed description are set forth for illutrating the general principles of the invention.

BRIEF DESCRIPTION OF THE DRAWINGS

Figure 1:
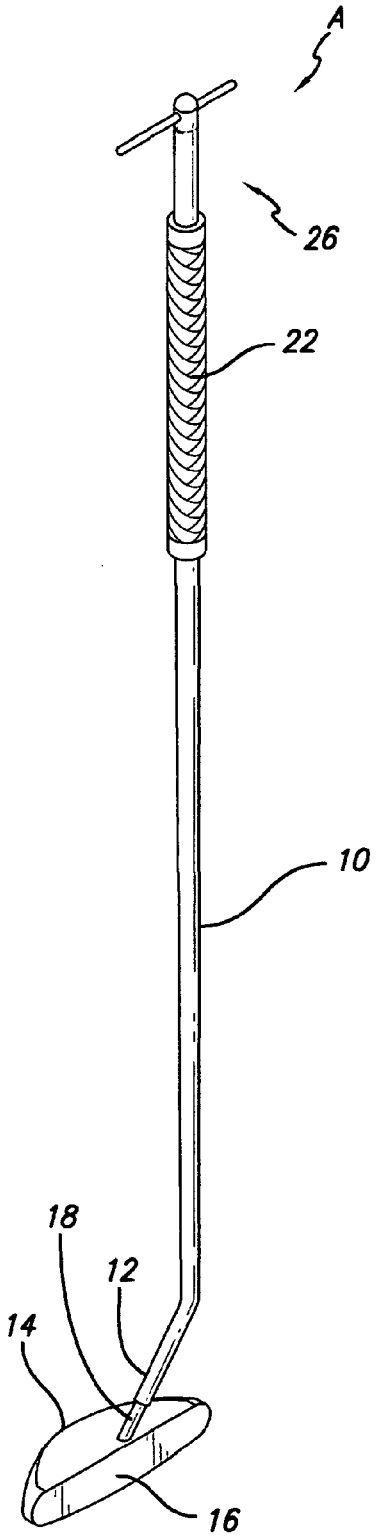
Figure 2:
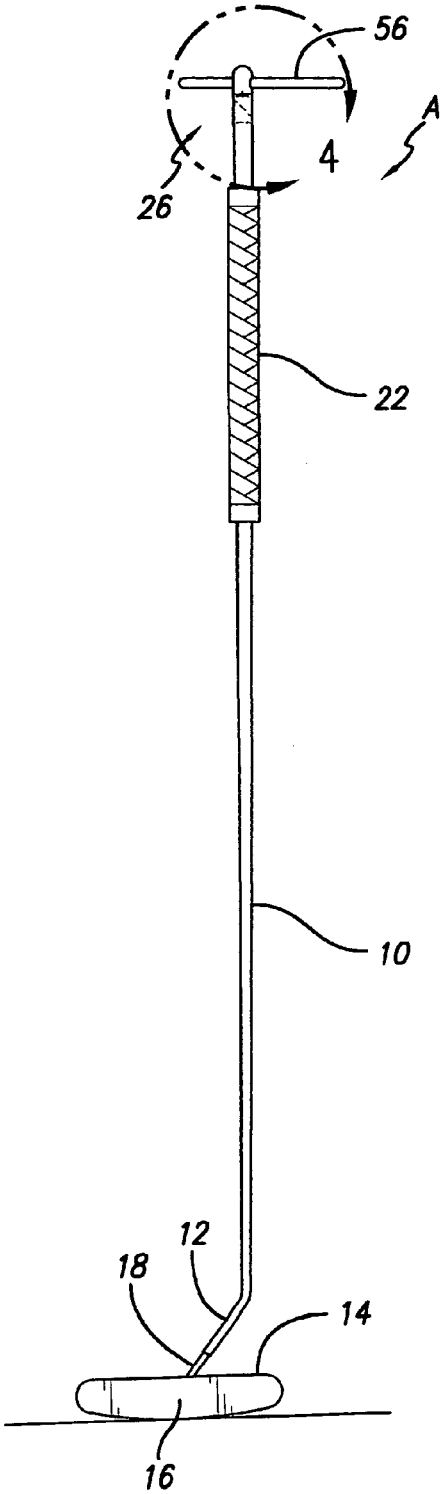
Figure 3:
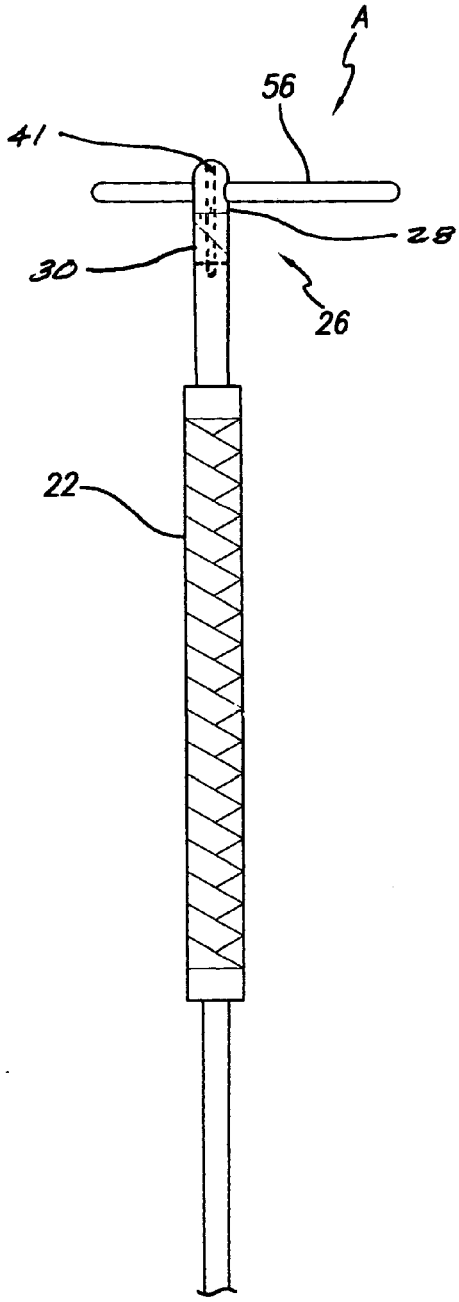
Figure 4:
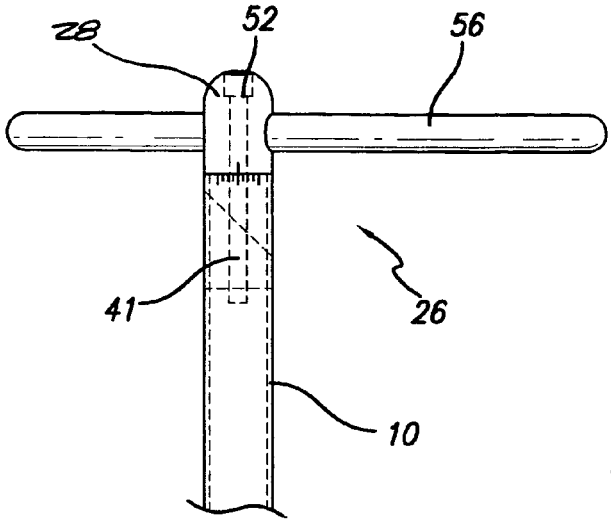
Figure 5:
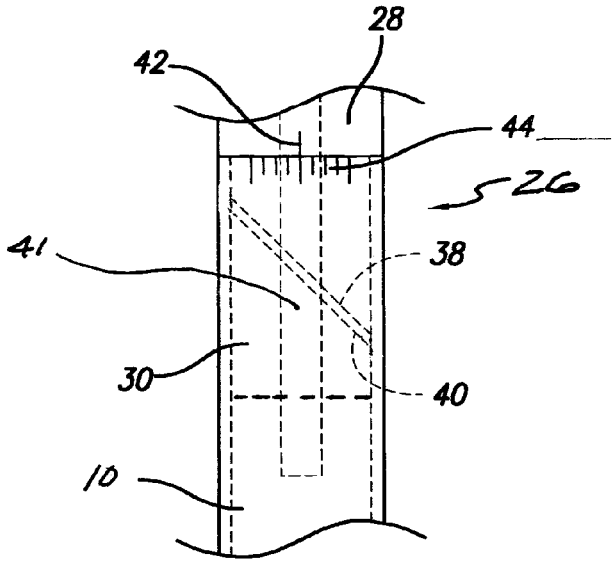
Figure 6:
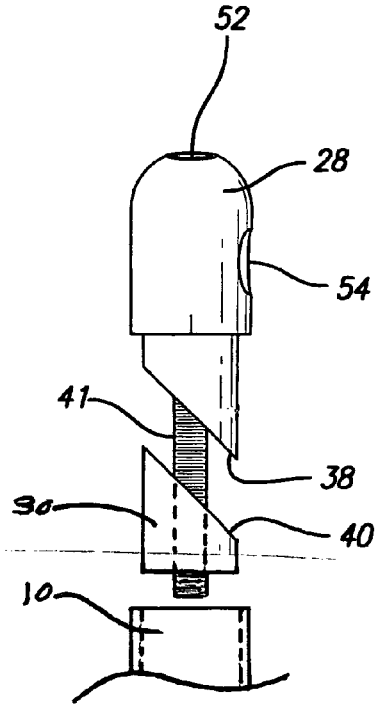
Figure 7:
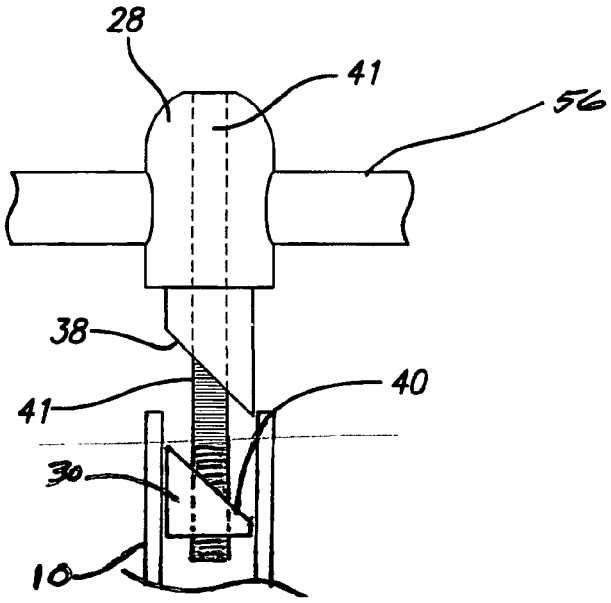
Figure 8:
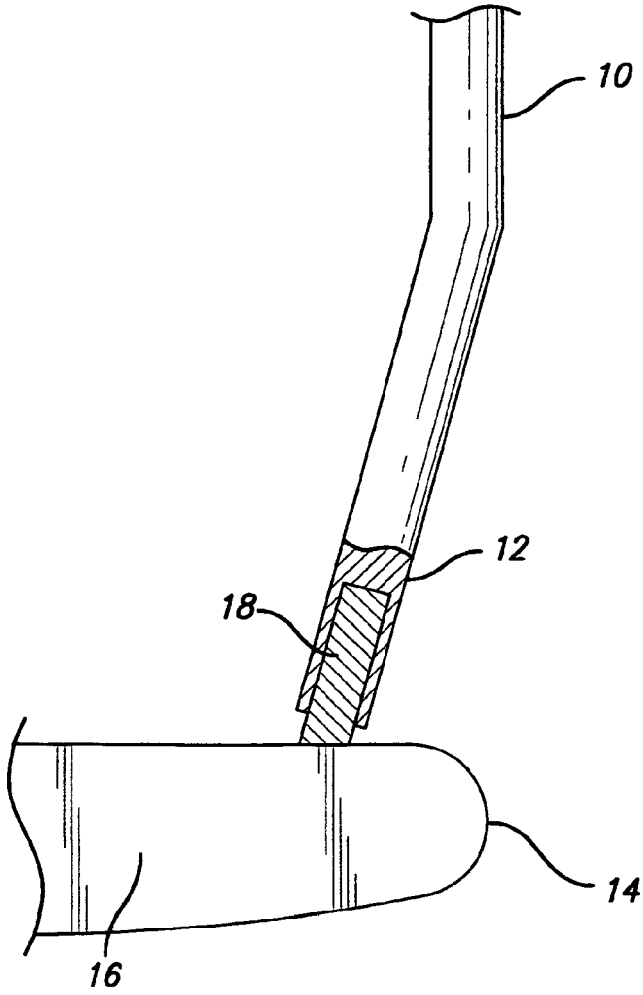
Figure 9:
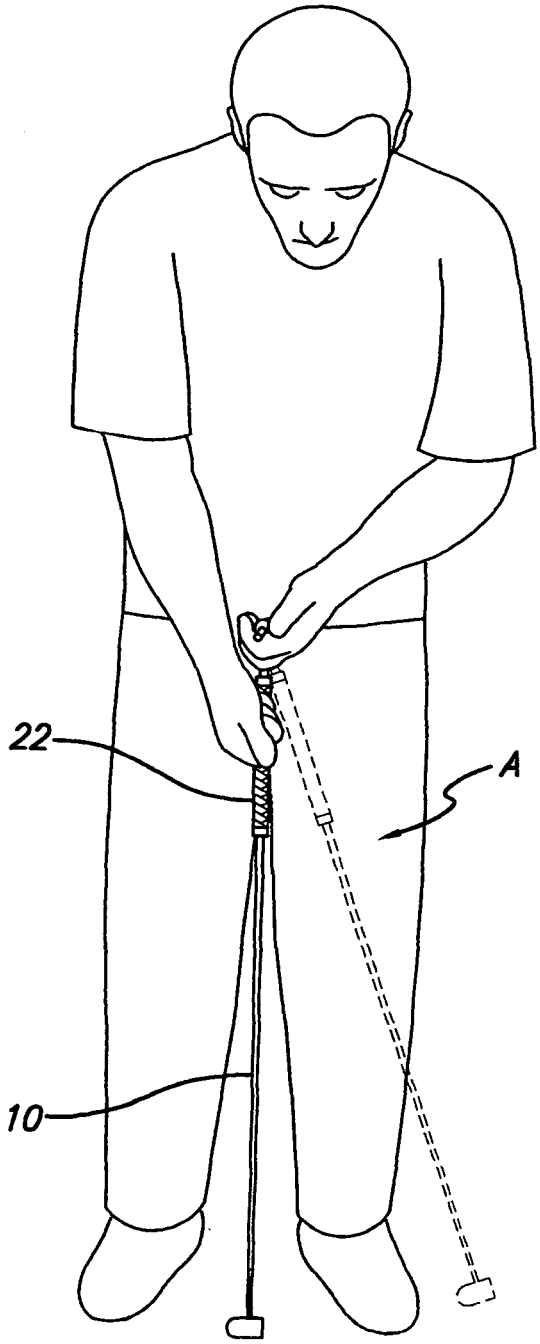
Figure 10:
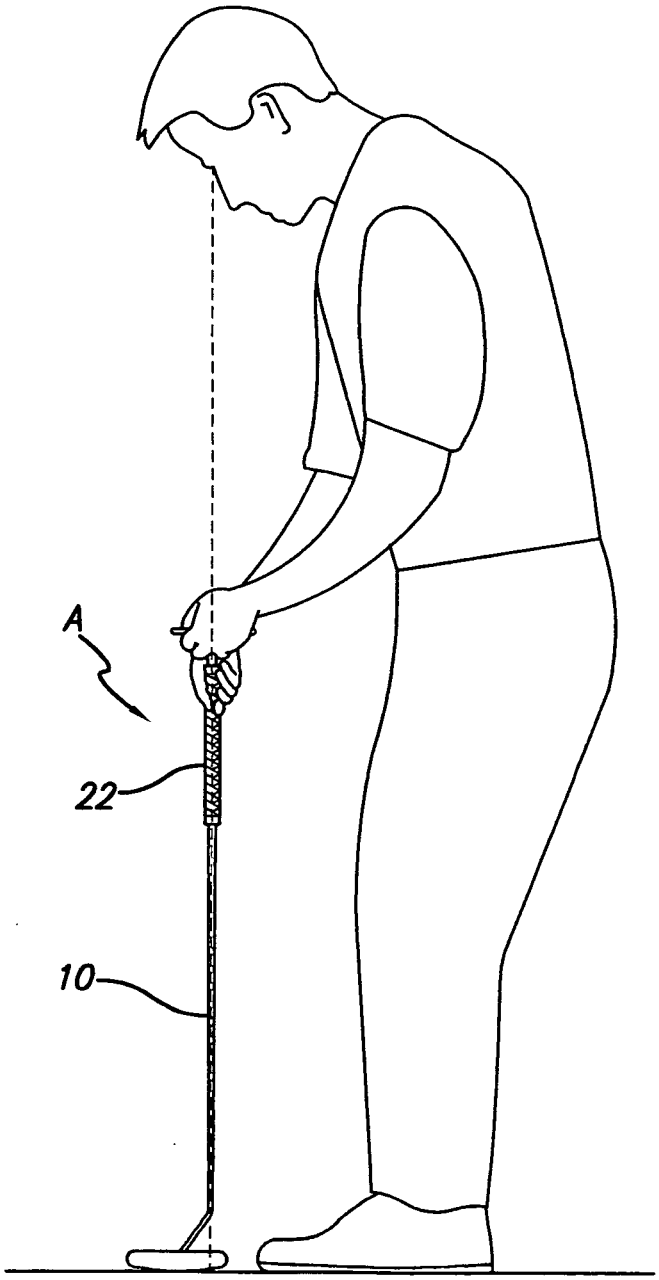

Having thus described the invention in general terms, reference will now be made to the accompanying drawings in which:

FIG. 1 is a perspective view of a golf club putter in accordance with and embodying the present invention;

FIG. 2 is an elevation view of the golf club of FIG. 1;

FIG. 3 is an enlarged view of the upper portion of the golf club and showing the construction allowing the crown section of the golf club to be angulated relative to the remainder of the club shaft;

FIG. 4 is an enlarged somewhat schematic view partially broken away and in section showing the construction of the upper portion of the golf club shaft;

FIG. 5 is a somewhat schematic fragmentary sectional view of that portion of the club shaft of FIG. 4 and showing a mounting of a crown portion and an angulation scale on the shaft;

FIG. 6 is a fragmentary side elevation view, partially broken away, of the crown portion of the golf club and showing the positioning thereof so that the upper handle section is angulated relative to the club shaft;

FIG. 7 is a sectional view of the position adjusting mechanism forming part of the golf club of the invention;

FIG. 8 is a lower end elevation view of the golf club shaft showing the positioning of a club head thereof relative to a ground surface;

FIG. 9 is a somewhat schematic view showing a stance of a player using a golf club of the invention; and FIG. 10 is an elevation view showing a swinging movement of a golf club of the invention by a player.

DETAILED DESCRIPTION OF THE INVENTION

Referring now in more detail and by reference characters to the drawings which illustrate practical embodiments of the present invention. FIG. 1 designates a golf club in the nature of a putter and comprises an elongate generally vertically arranged shaft 10. Preferably, although not necessarily, the shaft is cylindrically shaped and is relatively straight over a greater portion of its length.

At its lower end, the shaft is integrally provided with an angularly offset stub portion 12. This angularly offset portion 12 carries at its lower end, a golf club head 14 having a relatively flat forwardly presented face or so-called striking face 16 which engages a golf ball and propels same when the club is swung. The club head 14 may be integral with the stub portion 12 which connects the head 14 to the golf club shaft and may be physically connected to the golf club, as desired. The head 14 can be typically provided with a bracket (not shown) on its rear face for connection to the stub portion 12. Otherwise, the head may have a projection 18 extending upwardly and tightly fitted within a lower end of a tubular shaft, as hereinafter described in more detail. In some cases, the striking surface 16 may have a ribbed face design which would not interfere with a striking movement of the golf ball.

The angulated stub shaft 12 is located at an angle of about 15 to about 22 degrees with respect to a vertical axis of the shaft. However, in a more preferred embodiment of the invention, the stub shaft 12 is angulated at about 18 degrees, as shown in FIG. 8. This has been found to be the most desirable angle for enabling the stub shaft 12 to be short, but yet allow sufficient room for the putter to be swung without engaging the feet or any other obstruction in the swinging movement of the club.

Intermediate its upper and lower ends, the main shaft 10 is provided with an enlarged hand grip 22. The diameter of the hand grip 22 is slightly enlarged relative to the remainder of the shaft 10 and is specifically sized so that a user may grasp the hand grip 22 with his lower hand, much in the manner as shown in FIGS. 9 and 10 of the drawings.

At its upper end, the golf club is provided with a handle 26 as shown in FIGS. 1 and 2 and which is adjustably positionable on the golf club shaft in a manner as hereinafter described in more detail. The handle 26 is either at or in proximity to an end of the golf club shaft.

It can be seen by reference to FIGS. 4, 5 and 6 that when the handle/crown is turned, the entire assembly of 28,30,41 and 56 (held together by the 41 bolt threaded into 30), rotate as one unit (assembly) within the inside diameter of the 10 shaft thus changing the degree between the putter face 16 and the handle 56. So it should be noted that by rotating the entire handle assembly (28,30,41 and 56) within the shaft 10 inside diameter a desirable angle of degree to compensate for the users own physical pronation and/or supination can be achieved. A scale 44 showing the angular position of the putter is imprinted on the outer surface at the upper end of the putter shaft and cooperates with an index mark 42 on the 28 crown.

See FIGS. 4 and 5. In this way, the user of the putter can always determine the correct angular position for obtaining consistent results. The upper end of the bolt is provided a with bolt shank that extends axially through the crown, threading into the second camming 30 portions of the position adjusting mechanism, and is secured by means of the bolt 41 as shown in FIG. 7. Moreover, the bolt 41 is provided with a recessed head 52 in the manner as shown in FIG. 4 of the drawings. In this way, the cap portion of the handle could be removed if desired. This also allows scale and index markings to be set in any conventional manner.

The crown 28 as shown in FIG. 6 is provided on its sidewall with an elongate radially extending opening 54 and which, in turn, receives a finger engaging rod or grip 56. Moreover, the finger engaging rod 56 is typically shiftable in the opening 54 such that it may extend outwardly from the crown by a greater distance on one side than on the other.

The scale and mark are embossed graduated degree markings, that is, they will enable the user to determine the degree of rotation of the upper crown 28 as shown in FIG. 5 relative to the remainder of the club shaft 10. In addition, it can be seen that the positionable crown 28 and the rod 56 will constitute a T-shaped handle.

From a user's standpoint, it is highly effective in that it allows the user to compensate for the supination or pronation of his arms relative to the putter shaft. By use of the degree scale, and index mark the user will shortly begin to observe the number of degrees that he may rotate the club shaft, possibly inadvertently, by the positioning of his arms and hands. As a result, the user can compensate for this inadvertent rotation such that the user may hold the shaft in a normal comfortable position for that user and still allow putting as though there were no offset in the position of the club head 16.

In accordance with the above construction the crown 28 can be rotated and the angle between the crown 28 and the shaft can be set by the user. It is only necessary for the user to release the bolt 41 slightly and rotate the crown 28 to a desired position and thereafter re-tighten the bolt. This will cause the entire crown/handle to be angulated relative to the remainder of the club shaft.

Thus, there had been illustrated and described a unique and novel golf club which enables precise swinging movement and which thereby fulfills all of the objects and advantages which have been sought. It should be understood that many changes, modifications, variations and other uses and applications will become apparent to those skilled in the art after considering this specification and the accompanying drawings which show embodiments of the invention. Therefore, any and all such changes, modifications, variations and other uses and applications which do not depart from the spirit and scope of the invention are deemed to be covered by the invention.

Having thus described the invention in general terms, what I desire to claim and secure by letters patent is:

1. A golf club with a handle that allows a right handed or left handed user to swing the golf club with an adjustable 0 degree to 360 degree rotation of the handle with respect to a striking surface of a club head, said club comprises:

(a) a golf club shaft;

(b) the club head attached to a lower end of said shaft;

(c) the striking surface on said club head located to strike a golf ball when the shaft is swung;

(d) a crown rotatably attached to an upper end of said shaft; and (e) the handle with an axis perpendicular to a longitudinal axis of said shaft and in said crown so that a user can lightly grasp the handle and swing the club so that the striking surface of the head always engages the golf ball at the same angle.

2. The golf club of claim 1, wherein a grip is located and spaced downwardly from the handle along a length of the shaft, and said grip is to be gripped by another hand when the club is swung by the user when holding the club so that the user can apply a force to move the head striking surface through the same arc on each occasion when the shaft is swung.

3. The golf club of claim 2, wherein the grip has a length extending parallel to said longitudinal axis of said shaft, and said crown has a length so as to have a longitudinal axis parallel to the longitudinal axis of the shaft.

4. The golf club of claim 1, wherein the crown has a first camming surface wherein said first camming surface is located in the upper end of said shaft.

5. The golf club of claim 4, wherein a threaded base with a second camming surface is within the club shaft to wedge with the first camming surface of said crown to rotatably secure said crown in and to the upper end of said shaft.

6. The golf club of claim 5, wherein a bolt with threads when turned moves said threaded base axially towards or away from said crown to fix or release the crown to the shaft allowing an angle of 0 degrees to 360 degrees rotation between the shaft and the handle.

7. The golf club of claim 1, wherein an index mark is located on said crown and a scale is located on an upper surface of said shaft so that the user of the club can observe the adjustable rotation between the crown and the shaft.

8. The golf club of claim 1, wherein an angle of adjustment is able to be set between said handle and the longitudinal axis of said shaft, and said angle is able to be locked by means of a bolt.

* * * * *